US005879180A

United States Patent [19]

Iwahori et al.

[11] Patent Number: 5,879,180

[45] **Date of Patent: *Mar. 9, 1999**

[54] ELECTRIC CONNECTOR

[75] Inventors: Yoshihiro Iwahori; Yoshinori Uchida, both of Shizuoka-ken, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 717,274

[22] Filed: Sep. 20, 1996

[30] Foreign Application Priority Data

Sep. 21, 1995 [JP] Japan ..... 7-243195

[51] Int. Cl.[6] ..... H01R 13/627

[52] U.S. Cl. ..... 439/352; 439/353

[58] Field of Search ..... 439/352, 353, 439/489

[56] References Cited

U.S. PATENT DOCUMENTS

| | | | |
|---|---|---|---|
| 4,526,431 | 7/1985 | Kasukawa | 439/352 |
| 4,634,204 | 1/1987 | Detter et al. . | |
| 4,708,413 | 11/1987 | Schroeder . | |
| 4,946,395 | 8/1990 | Cope et al. | 439/352 |
| 5,120,255 | 6/1992 | Kouda et al. | 439/489 |
| 5,234,356 | 8/1993 | Maejima et al. | 439/352 |
| 5,348,493 | 9/1994 | Power | 439/352 |
| 5,399,045 | 3/1995 | Yoneda et al. | 439/352 |
| 5,605,472 | 2/1997 | Sakai et al. | 439/489 |

FOREIGN PATENT DOCUMENTS

| | | |
|---|---|---|
| 0 655 807 A2 | 5/1995 | European Pat. Off. . |
| 62-160674 | 7/1987 | Japan . |
| 62-229777 | 10/1987 | Japan . |
| 3-285280 | 12/1991 | Japan . |

*Primary Examiner*—Neil Abrams
*Assistant Examiner*—Katrina Davis
*Attorney, Agent, or Firm*—Finnegan, Henderson, Farabow, Garrett & Dunner, L.L.P.

[57] ABSTRACT

An electric connecter including a slider for confirming a locked condition between male and female connectors by movement between an intermediate locking position and a final locking position. When both connector housings initially connected partially, the slider comes into contact fitted a locking arm so that movement from the intermediate locking position to the final locking position is prevented, while when both connector housings are completely engaged, slider movement from the intermediate locking position to the final locking position is permitted. For preventing resilient deformation of the locking arm at a final locking position, a locking claw provided on the slider locking and an opposite fitting section with which the locking claw comes into contact, fit with each other at the final locking position for confirming termination of the slider movement toward the final locking position. Also, the locking claw fits with the opposite fitting position so that the slider does not move to the intermediate locking position unintentionally.

9 Claims, 9 Drawing Sheets

ELECTRIC CONNECTOR

BACKGROUND OF THE INVENTION

The present invention relates to an electric connector in which a locking arm and a corresponding fitting section are provided at a female connector housing and a male connector housing respectively, and in which an engagement of the locking arm with the fitting section make a locked condition between the female connector housing and the male connector housing.

FIGS. 1 to 3 show an electric connector 1 described in the Japanese Patent Application Laid-Open No. 3-285280. The electric connector 1, which is formed as a waterproof connecter, comprises a male connector 3, a female connector 5, and a lock-confirming slider 31. A waterproof hood 13, which surrounds a hood 11 of a female connector housing of the female connector 5, is provided in front of an outer peripheral portion of a male connector housing 7 of the male connector 3.

A notch 15 is provided at an upper portion of an outer peripheral wall of the waterproof hood 13, and a locking arm 17 extends from a support 19 fronting the notch 15.

The lock-confirming slider 31 includes a slider body 37 and a lock-confirming arm 39. The lock-confirming arm 39 is inclined slightly upward, a stopper 41 projects from the undersurface of a free end portion thereof, and a supporting guide 43 projects from the front thereof.

When the male connector housing 7 is engaged with the female connector housing 9, a locking projection 23 of the locking arm 17 slides over (FIG. 2) a return-prohibiting member 35 formed on the hood 11 of the female connector housing 9, before the locking arm 17 is deformed upward. With further advancing engagement, the locking arm 17 elastically returns downward before the locking arm is locked by engagement between the locking projection 23 and the return-prohibiting member 35. The lock-confirming arm 39 is deformed upward because the stopper 41 and the supporting guide 43 are engaged with the locking projection 23. When the engagement therebetween is released, the obstacle of the stopper 41 is removed, and the lock-confirming arm 39 advances through the passage 27 (FIG. 3) with the result that the lock-confirming slider 31 arrives at the lock-confirming position.

In this electric connector, the lock-confirming slider 31 first operates when engagement and locking between the female connector housing 9 and the male connector housing 7 are completely implemented, before engagement of the locking arm 17 with the lock-confirming arm 39 is released. Consequently, confirmation of complete implementation of locking is capable of being achieved.

However, in the above-described electric connector, even if the lock-confirming slider 31 arrives at the lock-confirming position, the lock-confirming arm 39 returns to the initial position only as a result its elasticity. The confirmation of whether or not the lock-confirming slider 31 arrives with certainty at the lock-confirming position is implemented by whether or not the the return of the lock-confirming arm 39 can be felt by touch. For this reason, in order to detect with certainty the arrival of the lock-confirming slider 31 at the lock-confirming position, it is necessary to perform a pulling operation of the lock-confirming slider 31 to determine whether or not the stopper 41 is caught by the locking projection 23, with the result that the procedure for confirming the locking state is time-consuming.

SUMMARY OF THE INVENTION

In view of the foregoing, it is an object of the present invention to provide an electric connector by which it can be easily determined whether or not a slider has arrived with certainy at a lock-confirming position (final locking position), and by which a lock-confirmation is facilitated.

According to one aspect of the present invention, for achieving the above-mentioned object, there is provided an electric connector having a male connector housing, a female connector housing, a flexible locking arm provided on the male connector housing and being resiliently deformed during engagement between the male and the female connector housings for permitting relative movement of the male connector housing and the female connector housing, a fitting section provided on the female connector housing, for fitting with the locking arm so as to achieve a locked condition when the male connector housing is completely engaged with the female connector housing, and a lock-confirming slider universally mounted on the male connector housing, which allows it to be moved between an intermediate locking position and a final locking position. When both connector housings are in an incomplete engagement condition, the slider comes into contact with and to be engaged by the locking arm so that movement from an intermediate locking position to a final locking position is prevented, while when both connector housings are in the complete engagement condition, movement from the intermediate locking position to the final locking position is permitted. For preventing a resilient deformation of the locking arm fitted with the fitting section at a final locking position, a locking claw is provided on the slider for confirming final locking, and an opposite fitting section with which the locking claw comes into contact to be slid, when the slider moves from the intermediate locking position to the final locking position, and the opposite fitting section fits with the locking claw at the final locking position for confirming a termination of movement to the final locking position for the slider.

As stated above, in this electric connector, after engagement of the male connector housing with the female connector housing, when the lock-confirming slider is moved from the intermediate locking position to the final locking position, the locking claw comes into contact to be slid with the opposite fitting section of the locking arm. When movement of the slider to the final locking position is terminated, the locking claw fits with the opposite fitting section. For this reason, the termination of movement to the final locking position of the slider can easily be confirmed with the result that the lock-confirmation operation is facilitated.

According to the another aspect of the present invention, there is provided an electric connector having slider comprising a slider body, and a flexible lock-detection arm projected from the slider body, for coming into contact to be fitted with the locking arm at the intermediate locking position, and at the time when the locking arm fits with the fitting section, the coming-into-contact to be fitted condition with regard to the locking arm is released due to contacting with the fitting section, when the slider is moved to the final locking position, the lock-detection arm prevents the locking arm from resilient deformation.

As stated above, when the male connector housing engages with the female connector housing, the locking arm fits with the fitting section and the lock-detection arm fits with the fitting section, so that the coming-into-contact to be fitted condition between the locking arm and the lock-detection arm is released. At this condition, when the slider is made to move from the intermediate locking position to the final locking position, the locking claw comes into contact to be slid with the opposite fitting section during this movement. After this sliding contact, on account of fitting of the locking claw with the opposite fitting section, the termination of movement of the slider toward the final locking position can easily be confirmed.

Further, the locking claw is formed on said slider body, and the opposite fitting section is formed on the outer peripheral wall of the locking arm so that the fitting condition of the locking claw with the opposite fitting section is capable of being confirmed.

As stated above, after the male connector housing engages with the female connector housing, when the slider is made to move from the intermediate locking position to the final locking position, the locking claw comes into contact to be slid with the opposite fitting section during this movement, on account of fitting between the locking claw and the opposite fitting section, and the termination of movement of the slider to the final locking position can easily be confirmed.

Furthermore, the locking arm includes a pair of flexible arm sections which are projected in the same direction thereof from outer peripheral wall of the male connector housing in a designated space, and a coupling section for coupling free-end side sections of the arm sections together, whereby the lock-detection arm of the slider is inserted into the space between the arm sections so that a pointed end section of the lock-detection arm comes into contact to be fitted with said coupling section, with the result that the locking arm is prevented from movement toward the final locking position.

As stated above, the lock-confirming slider is prevented from movement toward the final locking position because the pointed end section of the lock-detection arm comes into contact to be fitted with the coupling section, and then since the male connector housing is completely engaged with the female connector housing so that it makes both connector housings to be in a locked condition, the fitting section comes into contact to be fitted with the lock-detection arm, thereby the coming-into-contact to be fitted condition between the pointed end section of the lock-detection arm and the coupling section is released, with the result that the lock-confirming slider is permitted to move toward the final locking position. For this reason, the slider does not move from the intermediate locking position to the final locking position unintentionally, further, since movement toward the final locking position can easily be confirmed, after having been moved to the final locking position, the locking claw fits with the opposite fitting section, the slider does not move from the intermediate locking position to the final locking position unintentionally.

Moreover, the opposite fitting section can be formed across between the arm sections at the outer side section of the arm section.

As stated above, the opposite fitting section can be formed across and between the arm sections so that the passage in which the pointed end section of the lock-detection arm can be passed through is well defined, and the pointed end section of the lock-detection arm must come into contact with the coupling section for coupling the arm section. For this reason, the slider does not move from the intermediate locking position to the final locking position unintentionally.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

DESCRIPTION OF THE PREFERRED EMBODIMENTS

A preferred embodiment of the present invention will now be described in detail referring to the accompanying drawings.

Figure 1:
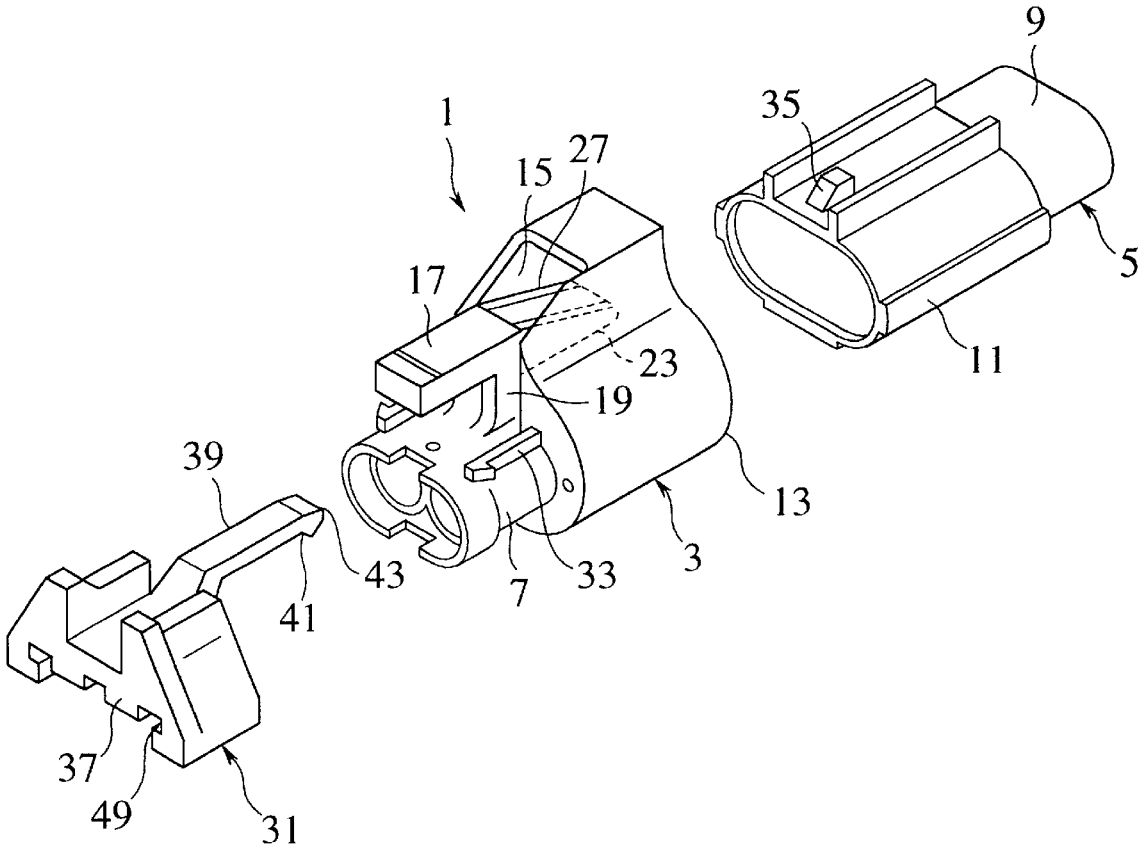
FIG.1 PRIOR ART
FIG. 1 is an exploded perspective view showing a conventional electric connector.
Figure 2:
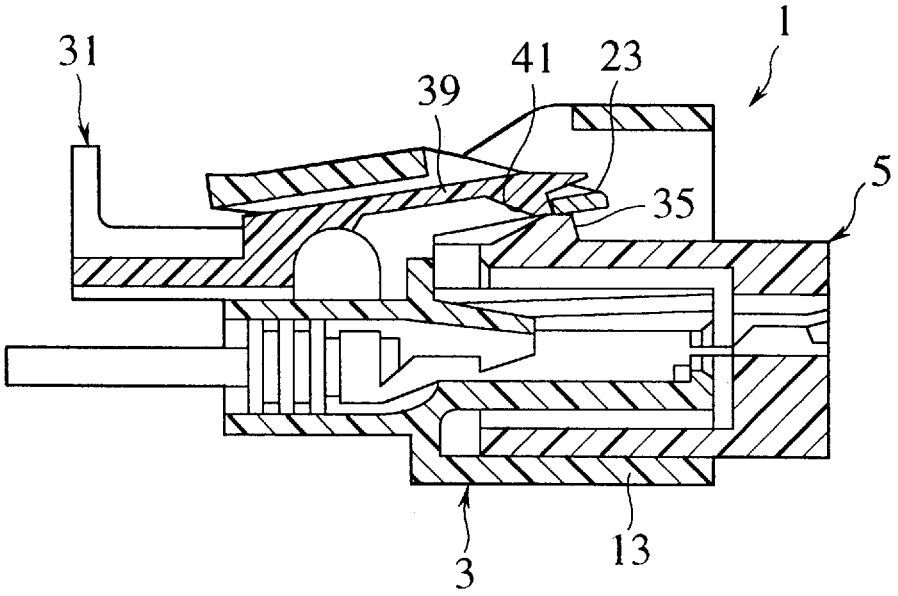
FIG.2 PRIOR ART
FIG. 2 is a cross sectional view showing a condition causing a slider to move toward the position for confirming locking state in the conventional electric connector.
Figure 3:
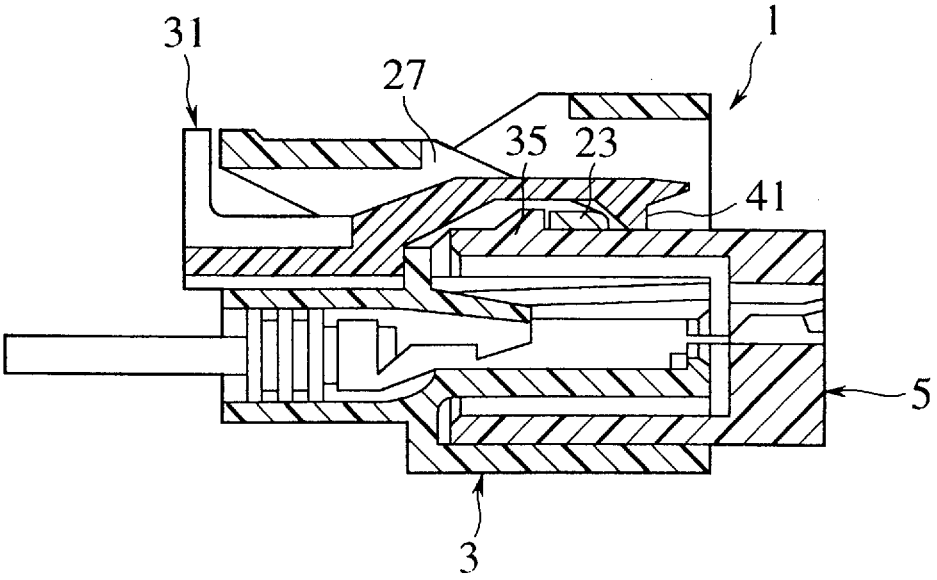
FIG.3 PRIOR ART
FIG. 3 is a cross sectional view showing a condition where the slider has been moved at the lock-confirming position for confirming locked condition in the conventional electric connector.
Figure 4:
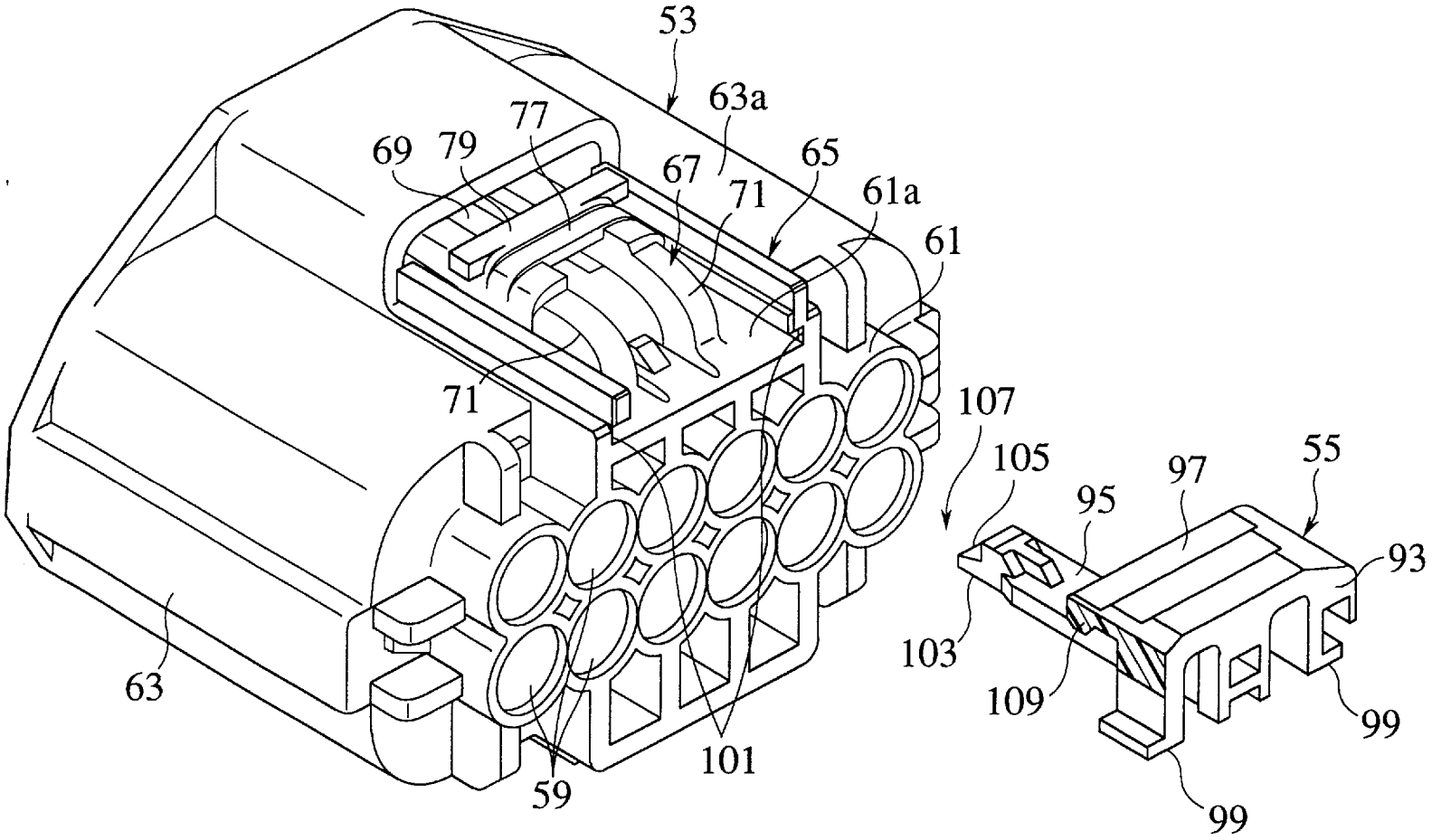
FIG. 4 is an exploded perspective view showing a male connector and a slider of the electric connector according to the present invention.
Figure 5:
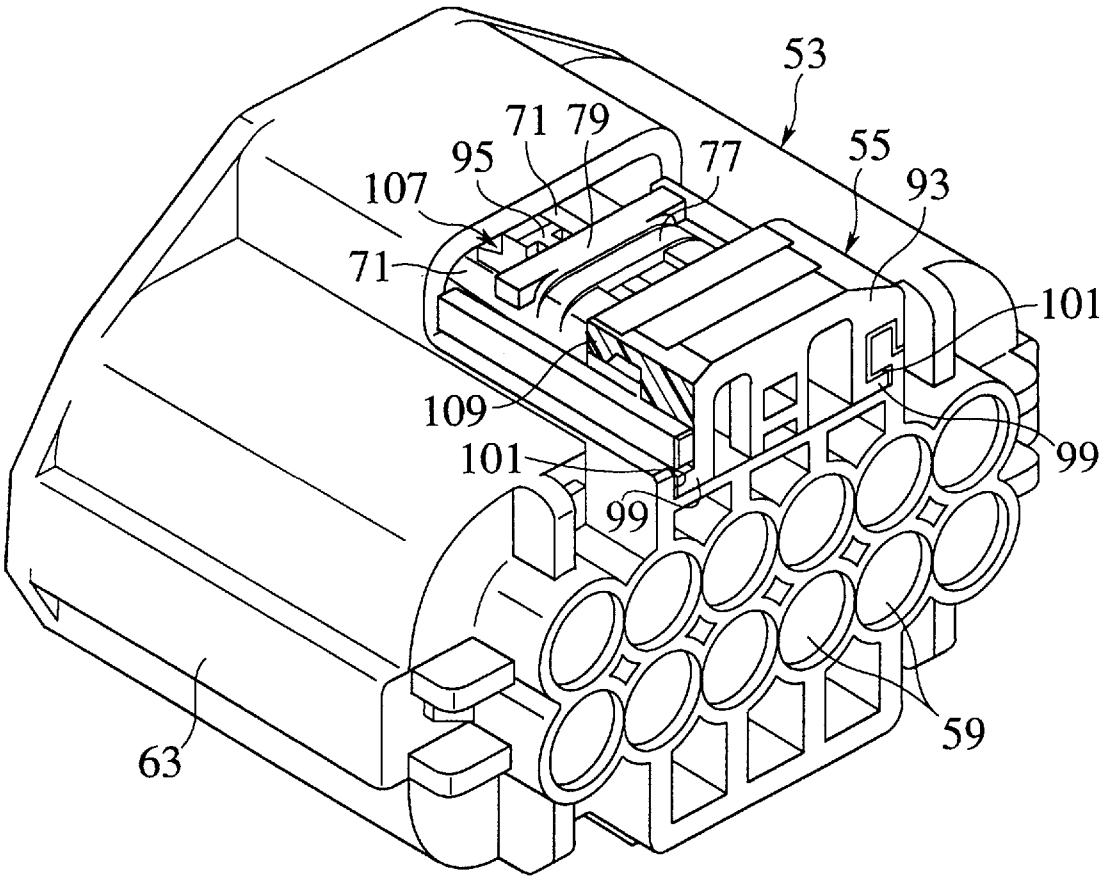
FIG. 5 is a perspective view showing a condition that the slider is mounted on the male connector of the electric connector according to the present invention.
Figure 6:
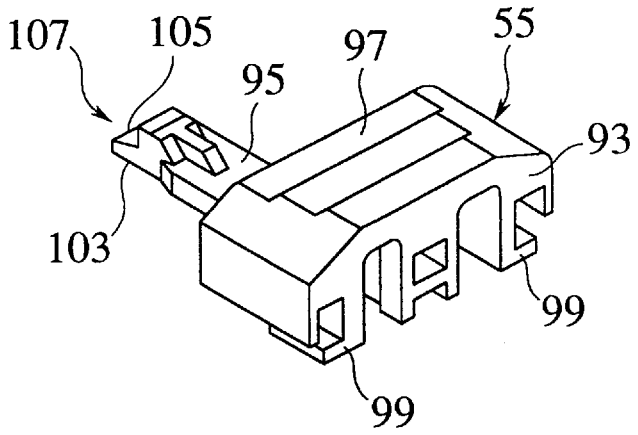
FIG. 6 is a perspective view showing the lock-confirming slider.

FIG. 4 is an exploded perspective view showing a relation between a male connector 53 of an electric connector 51 and a lock-confirming slider 55, FIG. 5 is a perspective view showing that the lock-confirming slider 55 is arranged at the male connector 53, and FIG. 6 is a perspective view showing the lock-confirming slider 55. Further, FIGS. 7 to 10 are perspective views showing an engagement procedure between the male connector 53 of the electric connector 51 and the female connector 57.

Figure 7:
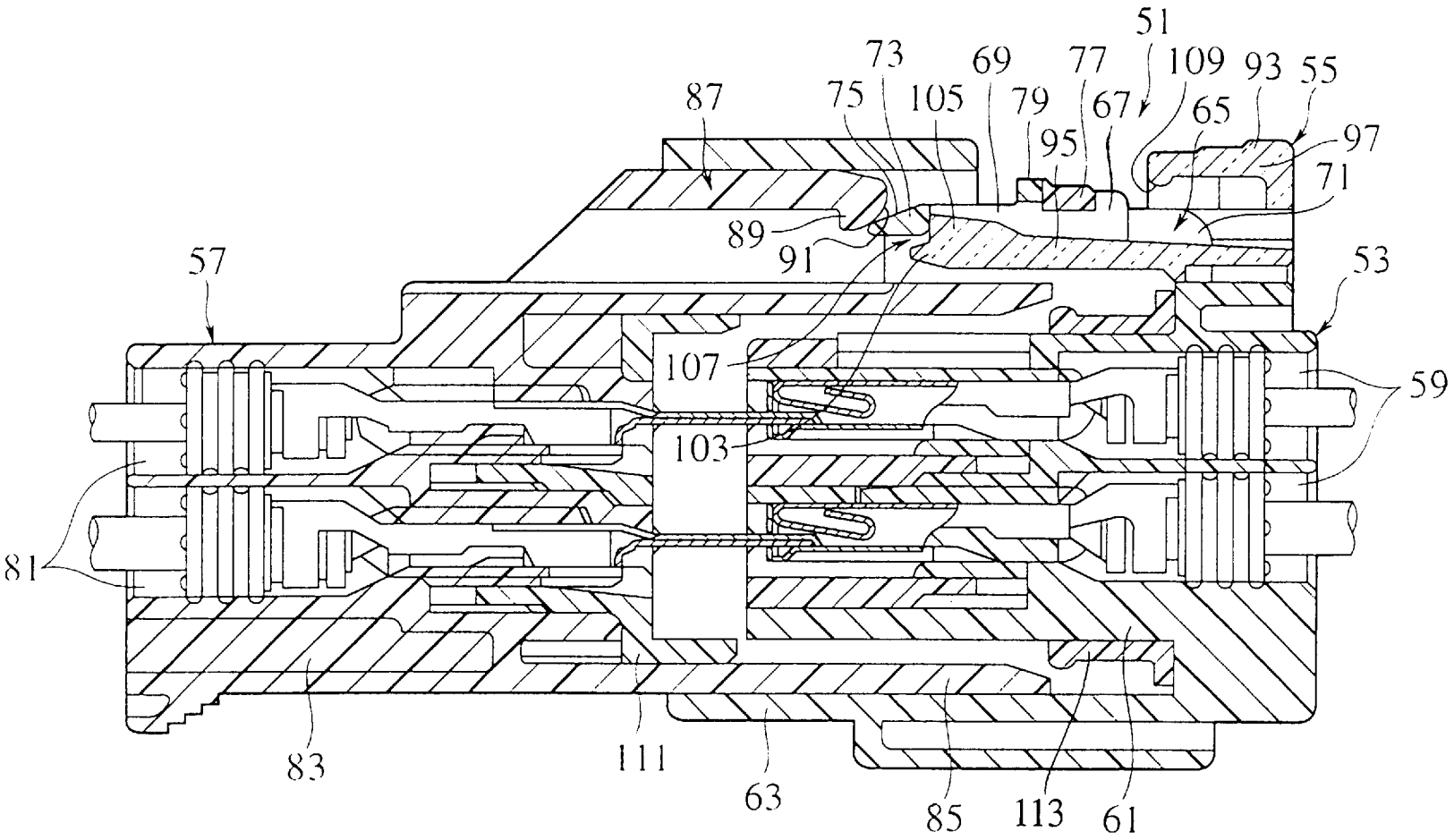
FIG. 7 is a cross sectional view showing a condition that the male connector housing is started to be inserted into engaging hood of the female connector in the electric connector.

As shown in FIG. 7, The present embodiment of the electric connector 51 comprises the male connector 53, the female connector 57 with which the male connector 53 is engaged, and the lock-confirming slider 55 for confirming locked condition in which the engagement condition between the male connector 53 and the female connector 55 has been maintained.

As shown in FIGS. 4 and 5, the male connector 53 comprises a waterproof hood 63, having designated space, is formed to be integrated with the outer periphery of the male connector housing 61 where terminal receiving chambers 59 shaped as two rows of the upper and lower side sections are formed. A part of the outer peripheral wall 63*a* of the waterproof hood 63 is made open, and a mounting section 65, on which the slider 55 is mounted, is formed. A locking arm 67 is provided at the mounting section 65. The locking arm 67 comprises a pair of flexible arm sections 71, 71 projecting in the same direction as the locking arm 67 from an opening or locking hole 69 which opens at the outer peripheral wall 61*a* of the male connector housing 61, and a coupling section 73 (FIG. 7) which connects the free end side sections of these arm sections 71, 71. The free end sections of the arm sections 71, 71 are covered by the part of the waterproof hood 63.

At a pointed end section of the coupling section 73, as shown in FIG. 7, an inclined surface 75 is formed. Further, an intermediate coupling section 77, which connects the pair of arm section 71, 71, is provided at the intermediate section of the arm sections 71, 71. An opposite fitting section 79 (see also FIGS. 4 and 5) is formed across the pair of arm sections 71, 71 between the intermediate coupling section 77 and the coupling section 73. A section between the coupling section 73 and the opposite fitting section 79 defines the locking hole 69. A locking claw 109 (described later) of the slider 55 comes into contact to be slid and fits with the opposite fitting section 79.

The slider 55 is mounted on the mounting section 65 in the intermediate locking condition in which a lock-detecting arm 95 of the slider 55 is inserted into the section between the pair of arm sections 71, 71 so that the lock-detecting arm 95 comes into contact with the coupling section 73, and the male connector 53 is initially engaged with the female connector 57.

As shown in FIG. 7, an engaging hood 85, in which the male connector housing 61 is engaged, is integrally formed with the female connector housing 83, on which terminal receiving chambers 81 are shaped as two rows of upper and lower side sections, are formed. A fitting section 87, into which the locking arm 67 is inserted, is formed on the hood 85. A fitting projection 89 is projected on the inside of the fitting section 87. An inclined surface 91 is formed on the fitting projection 89.

Figure 8:
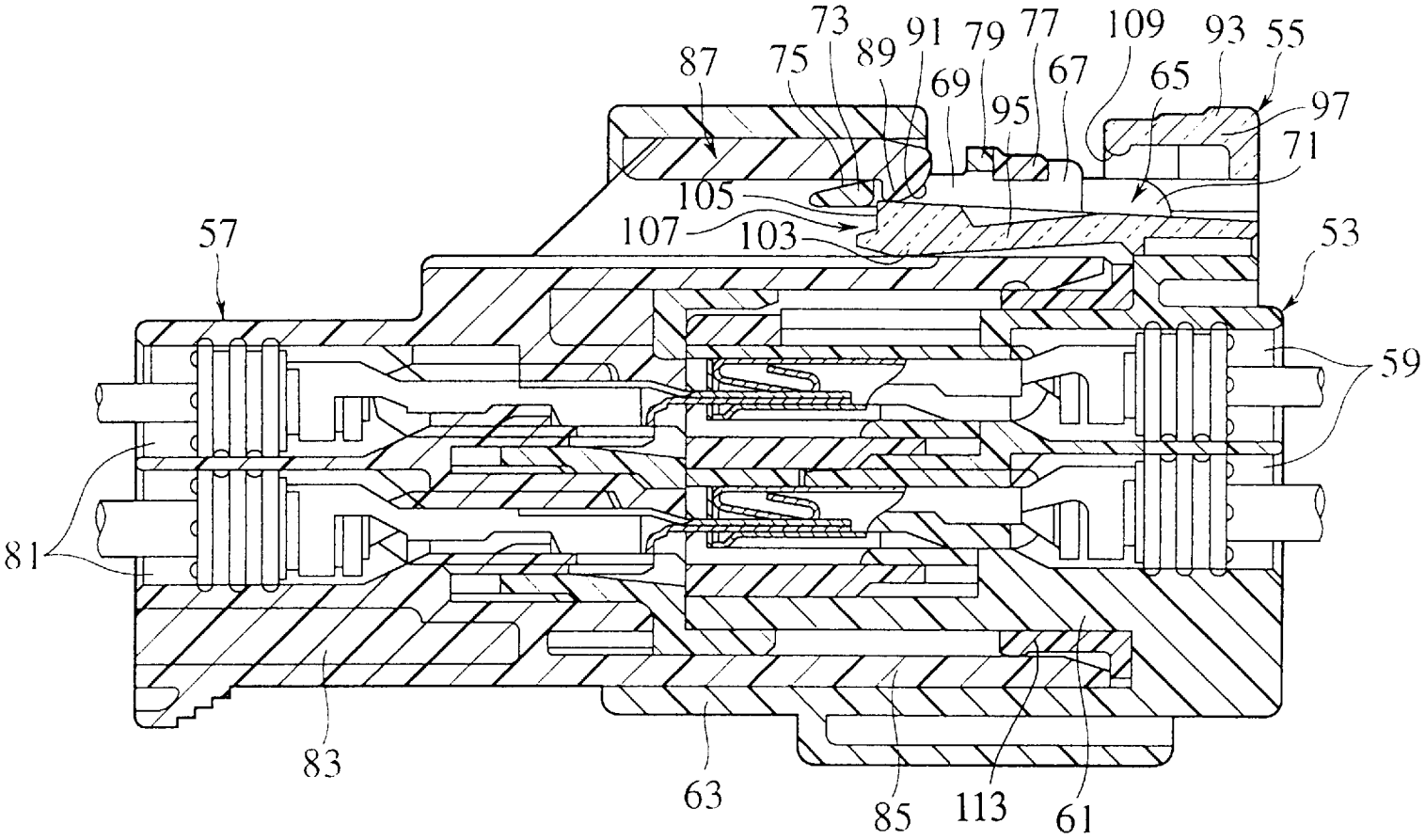
FIG. 8 is a cross sectional view showing a condition that the male connector housing is inserted completely into the engaging hood of the female connector of the electric connector.

As shown in FIG. 7, when the male connector 53 engages with the female connector 57, the inclined surface 75 of the locking arm 67 moves to be slid on the inclined surface 91. The locking arm 67 is resiliently deformed toward the male connector housing 61 so that relative movement between both connector housings 61, 83 is permitted. In the condition that the male connector 53 is completely engaged with the female connector 57, the coupling section 73 and the fitting projection 89 are so fitted that the coupling section 73 can slide under the fitting projection 89, resulting in a locked condition. At this time, as shown in FIG. 8, the fitting projection 89 comes into contact with the upper section of the lock-detection arm 95, which in turn, comes into contact with the coupling section 73 so that the fitting projection 89 pushes the lock-detection arm 95 out of the locking hole 69, with the result that it can be released to a fitting condition between the lock-detection arm 95 and the coupling section 73.

As shown in FIG. 6, the slider 55 comprises a slider body 93, and the lock-detection arm 95 projected from the slider body 93. L-shaped rail sections 99, 99 are integrally formed with both lower sections of the arch-shaped base section 97 respectively in the slider body 93. As shown in FIG. 5, these rail sections 99, 99 are movably fitted into the guide groove 101 provided at the outer peripheral wall 61*a* of the male connector housing 61 respectively.

One end of the lock-detection arm 95 is integrally supported in a roughly centered position between the rail sections 99, 99. A column section 107 with a supporting guide 103 and a stopper 105 are formed at the pointed end section of the lock-detection-arm 95.

As shown in FIG. 7, in a condition prior to the complete engagement of both connector housings 61, 83, where the slider is mounted on the mounting section 64 of the connector housing 61, the lock-detection arm is inserted into the section between the pair of arm sections 71, 71, and the stopper 105 comes into contact with and to be engaged by the coupling section 73, and movement toward the final locking position of the slider 55 is prevented.

A locking claw 109 is projected from the section of the lock-detection arm 95 side, which is the inside section of the base section 97 in the slider 55. When the slider 55 moves toward the final locking position, the locking claw 109 comes into sliding contact with the upper part of the opposite fitting section 79, and fits with the opposite fitting section 79 after terminating movement toward the final locking position. At this point, the condition of engagement of the locking claw 109 with the opposite fitting section 79 can easily be confirmed in that the locking claw 109 can climb over the opposite fitting section 79 so that the moderation-feeling is improved. Further, the condition in which the locking claw 109 has climbed over the opposite fitting section also can be confirmed visually.

Next, by using FIGS. 7 to 10, the fitting procedure and lock-confirming operation between the male connector 53 and the female connector 57 will be described.

As shown in FIG. 7, the slider 55 is pre-mounted on the mounting section 65 of the male connector housing 61. At this stage, the stopper 105 at the pointed end of the lock-detection arm 95 comes into contact with the coupling section 73 so that the slider 55 is mounted on the male connector housing 61 at the intermediate locking position. In this condition, the male connector housing 61 is engaged with the engaging hood 85 of the female connector 57, and the engaging hood 85 is engaged with the waterproof hood 63. In FIGS. 7 to 10, reference numeral 111 shows a member for implementing a halfway-insertion detection of the male terminal, and reference numeral 113 designates a seal member for sealing between the internal wall of the engaging hood 85 and the outer periphery of the male connector housing 61.

When the male connector housing 61 is inserted into the engaging hood 85 of the female connector 57, as shown in FIG. 7, the pointed end section of the locking arm 67 comes into contact with the fitting projection 89 so that the inclined face 75 slides on the inclined surface 91. When the male connector housing 61 is further inserted into the engaging hood 85, as shown in FIG. 8, the locking arm 67 can slide under the fitting projection 89 with the locking arm 67 deflected, so that it can obtain a complete engagement condition with the fitting projection 89 inserted into the inside of the locking hole 69, and the fitting projection 89 comes into contact with the lock-detection arm 95, before the engaging projection 89 pushes the lock-detection arm 95 out of the locking hole 69, with the result that the fitting condition of the lock-detection arm 95 with the coupling section 73 is released. For this reason, it becomes possible to move the slider 55 from the intermediate locking position to the final locking position, when both connector housings 61, 83 are of the complete engagement condition.

Figure 9:
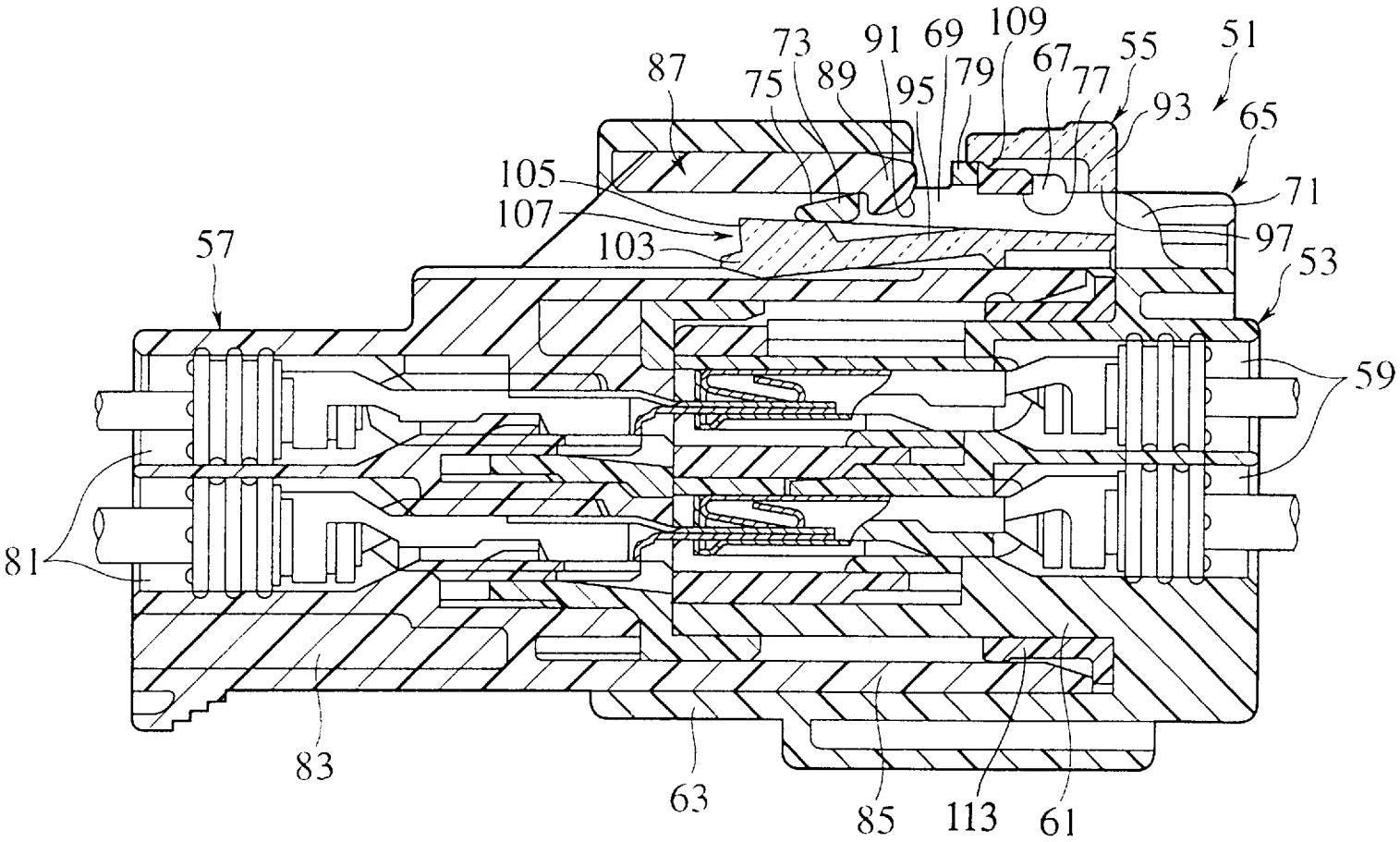
FIG. 9 is a cross sectional view showing a condition during movement of the slider from the intermediate locking position to final locking position with the condition that the male connector housing is inserted completely into the engaging hood of the female connector.
Figure 10:
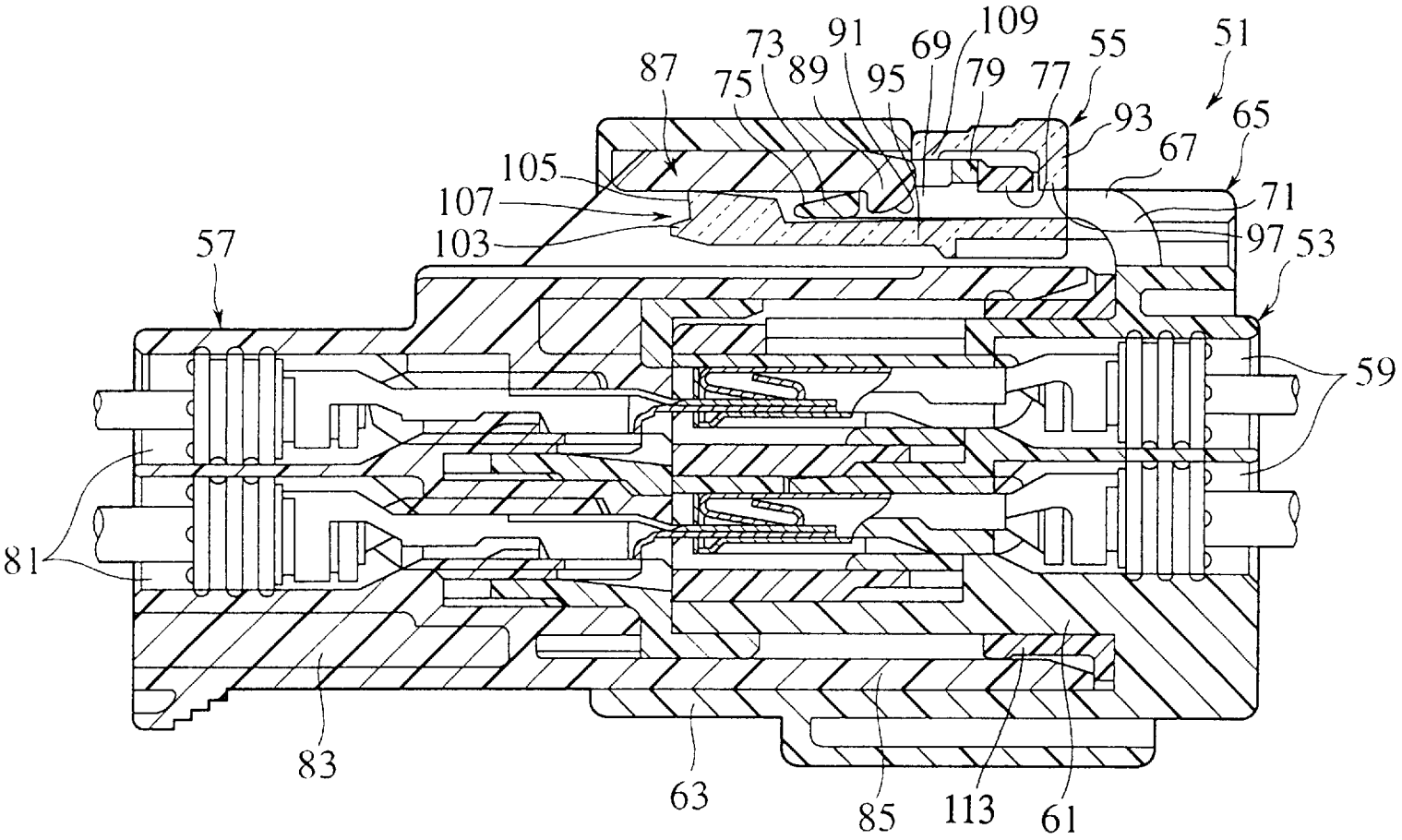
FIG. 10 is a cross sectional view showing a condition that the male connector is engaged with the female connector, before the slider is moved from the intermediate locking section to the final locking section.

From this condition, as shown in FIG. 9, when the slider 55 mounted on the intermediate locking position is made to move toward the female connector housing 83, the lock-detection arm 95 passes through between the coupling section 73 and the engaging hood 85, and the locking claw 109 comes into contact to be slid with the opposite fitting section 79. The locking claw 109 comes into contact to be slid with the opposite fitting section 79 so that the locking arm is slightly deflected. Due to the amount of the deflection, the engagement of the fitting projection 89 with the coupling projection 73 can not be released. Further, when the slider 55 is made to move toward the female connector housing 83, as shown in FIG. 10, the locking claw 109 climbs over the opposite fitting section 79 so that the locking claw engages with the opposite fitting section 79. At the same time, the lock-detection arm 95 is positioned at the side of the pointed end section of the coupling section 73.

When the slider 55 is moved from the intermediate locking position to the final locking position, since the locking claw 109 comes into contact to be slid with the opposite fitting section 79, before the locking claw 109 climbs over the opposite fitting section 79, it is capable of being confirmed with certainty that the slider 55 has moved to the final locking position due to improvement of the moderation-feeling. Further, it is capable of being confirmed with certainty that the slider 55 has moved to the final locked position by visually observing the inserted position of the slider 55.

At the condition that the slider 55 has completely moved at the final locking position, as shown in FIG. 10, the fitting projection 89 fits with the inside of the locking hole 69 of the locking arm 67, with the result that the lock-detection arm 95 is positioned at the lower section of the locking arm 67, namely at the lower section of the coupling section 73. For this reason, the locked condition between the male connector 53 and the female connector 57 is certainly maintained.

As stated above, according to the embodiment, when the slider 55 is moved from the intermediate locking position to the final locking position, the locking claw 109 comes into contact to be slid with the opposite fitting section 79 of the locking arm 67, and when the movement of the slider 55 toward the final locking position is terminated, the locking claw 109 engages with the opposite fitting section 79 all of which is capable of being easily confirmed by the operator making the slider 55 move. Namely, when the slide-contact condition for the opposite fitting section 79 of the locking claw 109 is terminated, since the sliding resistance at movement of the slider 55 is decreased suddenly, the moderation-feeling is improved, with the result that it is capable of being easily confirmed that the slide-contact of the locking claw 109 to the opposite fitting section 79 is terminated.

Further, at the condition that the slider 55 has moved at the final locking position, since the locking claw 109 fits with the fitted position, the slider 55 does not move to the intermediate locking position unintentionally.

Moreover, according to the embodiment, since the opposite fitting section 79 is provided at the locking arm 67, it is not necessary to form the opposite fitting section 79 by the elastic body.

While preferred embodiments of the present invention have been described using specific terms, such description is for illustrative purpose only, and it is to be understood that changes and variations may be made without departing from the spirit or scope of the following claims.

What is claimed is:

1. An electric connector comprising:

a male connector housing;

a female connector housing;

a flexible locking arm on said male connector housing, the locking arm being resiliently deformed during engagement between said male connector housing and said female connector housing for permitting relative movement of said male connector housing and said female connector housing;

a fitting section on said female connector housing for fitting with said locking arm to achieve a locked condition when said male connector housing is completely engaged with said female connector housing;

a slider for confirming the locked condition and slidably mounted on said male connector housing for movement between an intermediate locking position and a final locking position, said slider coming into contact with and engaged by said locking arm, when both connector housings are in condition of incomplete engagement and when the locking arm is in an undeformed state, so that movement from said intermediate locking position to said final locking position is prevented, being movable from said intermediate locking position to said final locking position when both connector housings are in a condition of complete engagement, and preventing a resilient deformation of said locking arm in the final locking position;

a locking claw on said slider; and an opposite fitting section with which said locking claw comes into sliding contact when said slider moves from said intermediate locking position to said final locking position, said opposite fitting section fitting with said locking claw at said final locking position for confirming termination of the slider movement to said final locking position.

2. An electric connector as claimed in claim 1, wherein said slider comprises a slider body and a flexible lock-detection arm which is projected from said slider body for coming into contact with and engaged by said locking arm at said intermediate locking position, for being released from engagement with said locking arm and sliding past said locking arm when said locking arm fits with said fitting section, said lock-detection arm preventing said locking arm from resilient deformation in the final locking position of the slider.

3. An electric connector as claimed in claim 2, wherein said locking claw extends from said slider body, and said opposite fitting section is located on an outer peripheral wall of said locking arm so that engagement of said locking claw and said opposite fitting section is capable of being confirmed.

4. An electric connector as claimed in claim 2 or 3, wherein said locking arm comprises a pair of spaced flexible arm sections projected in the same direction from an outer peripheral wall of said male connector housing, and a coupling section for connecting free-end portions of said arm sections, whereby said lock-detection arm of said slider is inserted between said spaced arm sections, so that a pointed end section of said lock-detection arm comes into contact with said coupling section to prevent movement of said locking arm toward said final locking position.

5. An electric connector as claimed in claim 4, wherein said opposite fitting section extends between said outer side portions of said arm section.

6. An electric connector comprising:

a male connector housing;

a female connector housing;

a flexible locking arm on said male connector housing the locking arm being resiliently deformed during engagement between said male connector housing and said female connector housing for permitting relative movement of said male connector housing and said female connector housing;

a fitting section on said female connector housing for fitting with said locking arm to achieve a locked condition when said male connector housing is completely engaged with said female connector housing;

a slider for confirming the locked condition and slidably mounted on said male connector housing for movement between an intermediate locking position and a final locking position;

a locking claw on said slider; and an opposite fitting section;

said slider having a slider body and a flexible lock-detection arm projected from said slider body, said lock-detection arm coming into contact with said locking arm when said locking arm does not fit with said fitting section and when the locking arm is in an undeformed state, so that movement of said slider from said intermediate locking position to said final locking position is prevented, said lock-detection arm sliding past said locking arm when said locking arm fits with said fitting section, so that movement of said slider from said intermediate locking position to said final locking position is allowed, said lock-detection arm fitting with said locking arm and preventing a resilient deformation of said locking arm in the final locking position, said locking claw coming into sliding contact with said opposite fitting section when said slider moves from said intermediate locking portion to said final locking portion and fitting with said opposite fitting section at said final locking position, whereby sliding resistance between said locking claw and said opposite fitting section decreases rapidly when the locking claw slides over the opposite fitting section and the locking claw fits with the opposite fitting section so that the slider movement to said final locking position is confirmed.

7. An electric connector as claimed in claim 6, wherein said locking claw extends from said slider body, and said opposite fitting section is located on an outer peripheral wall of said locking arm so that engagement of said locking claw and said opposite fitting section is capable of being confirmed.

8. An electric connector as claimed in claim 6 or 7, wherein said locking arm comprises a pair of spaced flexible arm sections projected in the same direction from an outer peripheral wall of said male connector housing, and a coupling section for connecting free-end portions of said arm sections, whereby said lock-detection arm of said slider is inserted between said spaced arm sections, so that a pointed end section of said lock-detection arm comes into contact with said coupling section to prevent movement of said locking arm toward said final locking position.

9. An electric connector as claimed in claim 4, wherein said opposite fitting section extends between said outer side portions of said arm section.

* * * * *